US008111590B2

(12) United States Patent
Asami et al.

(10) Patent No.: US 8,111,590 B2
(45) **Date of Patent: *Feb. 7, 2012**

(54) ELECTRONIC TIMEPIECE

(75) Inventors: Yoshinori Asami, Fussa (JP); Tomoo Kasuo, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/635,240

(22) Filed: Dec. 10, 2009

(65) Prior Publication Data

US 2010/0165797 A1 Jul. 1, 2010

(30) Foreign Application Priority Data

Dec. 26, 2008 (JP) ..... 2008-334197

(51) Int. Cl.
*G04B 1/00* (2006.01)

(52) U.S. Cl. ..... 368/204; 368/64

(58) Field of Classification Search ..... 368/203–205, 368/64

See application file for complete search history.

(56) References Cited

U.S. PATENT DOCUMENTS

| | | | | |
|---|---|---|---|---|
| 4,785,435 | A | 11/1988 | Inoue et al. | |
| 6,956,794 | B2 * | 10/2005 | Nakamura et al. | 368/203 |
| 2008/0246437 | A1 * | 10/2008 | Kitahara | 320/134 |
| 2010/0182880 | A1 | 7/2010 | Asami et al. | |

FOREIGN PATENT DOCUMENTS

| | | | |
|---|---|---|---|
| EP | 0 241 219 | A2 | 10/1987 |
| EP | 1 873 594 | A1 | 1/2008 |
| FR | 2 671 646 | A1 | 7/1992 |
| GB | 2 211 679 | A | 7/1989 |
| JP | 62-242882 | A | 10/1987 |
| JP | 08-036070 | A | 2/1996 |
| JP | 11-299125 | A | 10/1999 |
| JP | 2003-057366 | A | 2/2003 |

OTHER PUBLICATIONS

English Machine Translation of FR 2671646:: Source EPO espacenet.com; Dec. 19, 2010.*

Extended European Search Report dated Sep. 3, 2010 (in English) issued in counterpart European Application No. 09178997.4.

U.S. Appl. No. 12/635,177; First Named Inventor: Yoshinori Asami; Title: "Electronic Timepiece"; Filed: Dec. 10, 2009.

* cited by examiner

*Primary Examiner* — Sean Kayes

(74) *Attorney, Agent, or Firm* — Holtz, Holtz, Goodman & Chick, PC

(57) ABSTRACT

An electronic timepiece comprises a drive module configured to drive a hand, an electricity generation module, first and second capacitor modules, the second capacitor module having smaller capacitance than the first capacitor module, and an auxiliary drive control module which causes the drive module to perform the auxiliary driving when the charge level of the second capacitor module exceeds a third level indicating an amount of electricity which enables the auxiliary driving, and waits until the charge level of the second capacitor module exceeds the third level after performing the auxiliary driving.

3 Claims, 4 Drawing Sheets

STATE A

STATE B

STATE C

ELECTRONIC TIMEPIECE

CROSS-REFERENCE TO RELATED APPLICATIONS

This application is based upon and claims the benefit of priority from prior Japanese Patent Application No. 2008-334197, filed Dec. 26, 2008, the entire contents of which are incorporated herein by reference.

BACKGROUND OF THE INVENTION

1. Field of the Invention

The present invention relates to an electronic timepiece having a function of generating electricity.

2. Description of the Related Art

Electronic timepieces having various types of electricity generation functions have been implemented, for instance, solar powered timepieces, thermo-electrically powered timepieces, and quasi-self-winding timepieces, the latter converting the kinetic energy imparted by movement of a timepiece into electricity. By storing the generated electricity in a secondary battery for utilization later, such timepieces can operate even when electricity is not being generated.

If, in an electronic timepiece having an electricity generation function and a secondary battery, the secondary battery continues to discharge without electricity being generated, when generation of electricity eventually does occur, a long time is required for the output voltage of the secondary battery to recover. During this time, the timepiece remains stopped.

Hence, there exists a quick-start technique of adding a small auxiliary capacitor to the secondary battery, to quickly start the timepiece by charging the auxiliary capacitor and using the voltage thereof.

There also exists a technique (called a zero-reset), for a needle electronic timepiece, of stopping hands at a predetermined position before exhaustion of the secondary battery stops the timepiece, so that the position of the hands may not be lost when the power supply voltage recovers.

BRIEF SUMMARY OF THE INVENTION

According to an embodiment of the present invention, an electronic timepiece comprises:

a drive module configured to drive a hand;

an electricity generation module;

first and second capacitor modules configured to store electricity supplied from the electricity generation module, the second capacitor module having smaller capacitance than the first capacitor module; and an auxiliary drive control module configured to be capable of causing the drive module to perform an auxiliary driving by using electricity from the second capacitor module, until a charge level of the first capacitor module rises to a second level indicating recovery after the charge level of the first capacitor module has dropped to a first level, wherein the auxiliary-driving can be performed by a predetermined amount of electricity, and with a movement pattern in which the hand is driven and thereafter returned to a predetermined return position, and the auxiliary drive control module causes the drive module to perform the auxiliary driving when the charge level of the second capacitor module exceeds a third level indicating an amount of electricity which enables the auxiliary driving, and the auxiliary drive control module waits until the charge level of the second capacitor module exceeds the third level after performing the auxiliary driving.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of an electronic timepiece according to the present invention will now be described with reference to the accompanying drawings.

Figure 1:
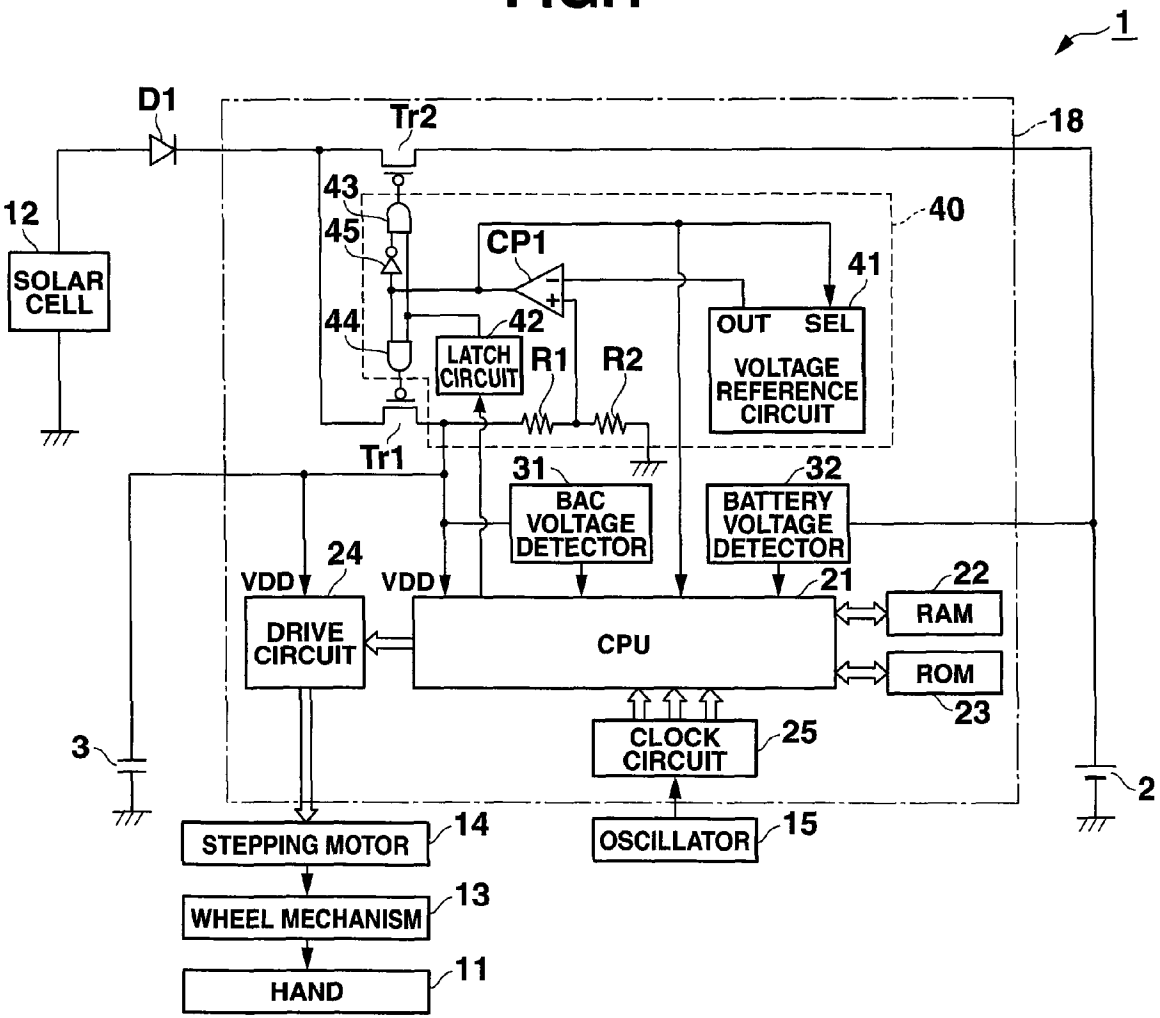
FIG. 1 is a block diagram depicting an internal structure of an electronic timepiece according to an embodiment of the present invention.

FIG. 1 is a block diagram illustrating an internal structure of an electronic timepiece according to the embodiment of the invention.

An electronic timepiece 1 according to this embodiment comprises an analog display module as a time display module that displays time by rotating plural hands (e.g., an hour hand, a minute hand, and a second hand) 11; and a solar power generation module as a power generation module that generates electricity by receiving light through a solar cell 12 located on, for example, a dial plate, and constitutes a body of, for example, a wrist timepiece.

As illustrated in FIG. 1, in addition to the hands 11 and solar cell 12, the electronic timepiece 1 comprises a diode D1 which rectifies a current generated by the solar cell 12; a secondary battery 2 as a first capacitor module and a capacitor 3 as a second capacitor module, which store generated electricity; a stepping motor 14 which drives the hands 11 to rotate; a wheel mechanism 13 which transmits motion of the stepping motor 14 to the hands 11; an oscillator 15 which generates an oscillation signal having a predetermined frequency for clocking time; and a large-scale integrated circuit (LSI) 18 in which various functional circuits are integrated.

The LSI 18 comprises a drive circuit 24 as a drive module which drives the stepping motor 14 by outputting a drive current to the stepping motor 14; a clock circuit 25 which receives an oscillation signal from the oscillator 15 to clock time; a central processing unit (CPU) 21 as a controller which performs various total control processing, such as a time display processing and a power supply switching processing; a RAM 22 which provides a work memory space for the CPU 21; a ROM 23 which stores control data and a control program; two switches Tr1 and Tr2 which switch connections to power supply destinations from the solar cell 12, as well as connections from power supply sources for a load circuit (including the CPU 21 and drive circuit 24); a switching circuit 40 which generates a switch signal for the switches Tr1 and Tr2; a battery voltage detector 32 which detects a battery voltage of the secondary battery; and a BAC voltage detector 31 which detects a power supply voltage reaching a battery-all-clear (BAC) voltage. In the structure described above, a power supply switching module and a charge switching module are constituted by the switches Tr1 and Tr2. A switching control module comprises the switching circuit 40 and CPU 21. A voltage detection module comprises the battery voltage detector 32 and a comparator CP1 in the switching circuit 40.

The secondary battery 2 charges and discharges electricity by utilizing an electrochemical reaction, and has capacitance which is extremely large compared with the capacitor 3. The secondary battery 2 has relatively large capacitance, and hence has a feature that, if once an output voltage drops as discharge proceeds, a relatively long time is required until the output voltage recovers by charge. Further, a charge amount (or remaining charge amount) of the secondary battery 2 does not make a linear relationship with the output voltage. The relationship between the charge amount and the output voltage varies depending on whether electricity is being charged or discharged, and depending on a size of an output current. Therefore, it is relatively difficult to obtain the charge amount of the secondary battery 2 from the output voltage.

The capacitor 3 is configured to store electric charges as electrostatic capacitance. A popular capacitor or an electric double-layer capacitor having relatively large capacitance can be used. The capacitor 3 has a feature that a charge amount can be relatively accurately obtained from an output voltage because a linear relationship is constituted between the electric charge amount and the voltage.

The switches Tr1 and Tr2 comprise, for example, MOS transistors or bipolar transistors, and switch a connection to a load circuit (including the CPU 21 and drive circuit 24) which operates receiving a power supply voltage VDD; a connection to the solar cell 12 which generates electricity; and a connection to the secondary battery 2 and capacitor 3 which charge and discharge electricity. Specifically, the switch Tr1 is provided on a path from the solar cell 12 to the capacitor 3 and on a path from the secondary battery 2 to the load circuit, and switches on/off the connection between the solar cell 12 and the capacitor 3 and the connection between the secondary battery 2 and the load circuit. The switch Tr2 is provided on a path connecting the solar cell 12 or the load circuit to the secondary battery 2, and switches on/off the connection between the secondary battery 2 and the solar cell 12 and the connection between the secondary battery 2 and the load circuit.

The drive circuit 24 pulsates the power supply voltage VDD, depending on a timing pulse from the CPU 21, and outputs the pulsated voltage to the stepping motor 14, thereby to drive the stepping motor 14 to rotate step by step.

The battery voltage detector 32 compares a voltage of the secondary battery 2 with two threshold voltages Vth2 and Vth3 (see FIG. 2), and outputs a comparison signal thereof to the CPU 21.

The BAC voltage detector 31 is to put the LSI 18 in an all-clear state before the power supply voltage VDD drops below a lower limit operation voltage thereby causing the LSI 18 to operate unstably. A threshold voltage Vth4 (see FIG. 2) slightly higher than the lower limit operation voltage is compared with the power supply voltage VDD. If the power supply voltage VDD is lower than the threshold voltage Vth4, the BAC voltage detector 31 outputs an all clear signal to the CPU 21. The LSI 18 is reset by the all clear signal, and clock data of the clock circuit 25 is thereby reset.

The switching circuit 40 comprises AND gates 43 and 44 which output switch signals to control terminals of the switches Tr1 and Tr2; a latch circuit 42 which is connected to one input terminal of each of the two AND gates 43 and 44; a comparator CP1 which outputs a signal to another input terminal of each of the AND gates 43 and 44; an inverter 45 which inverts an output of the comparator CP1, only for the AND gate 43; a voltage reference circuit 41 which generates two types of comparative reference voltages for the comparator CP1; and dividing resistors R1 and R2 which divide the voltage of the capacitor 3 for voltage comparison performed by the comparator CP1.

Data is set in the latch circuit 42 from the CPU 21, and depending on a data value, the latch circuit 42 outputs a high- or low-level signal to the one input terminal of each of the two AND gates 43 and 44. Although details will be described later, the CPU 21 switches the data value in the latch circuit 42, based on voltage detection of the secondary battery 2.

The comparator CP1 compares a reference voltage supplied from the voltage reference circuit 41 with a divided voltage of the capacitor 3, and outputs a high- or low-level signal depending on the result of comparison.

The voltage reference circuit 41 generates and outputs two types of reference voltages from an output terminal OUT to an inverted input terminal of the comparator CP1. First type one of the reference voltages is a voltage (which is obtained by dividing the threshold voltage Vth1 at a dividing ratio of the dividing resistors R1 and R2: Vth1×(R2/(R1+R2))) corresponding to a threshold voltage Vth1 (see FIG. 2) indicating a fully charged capacitor 3. Second type one of the reference voltages is a voltage corresponding to the threshold voltage Vth3 (see FIG. 2) indicating that the voltage of the capacitor 3 has dropped to a charge level.

These two types of reference voltages are switched by a select signal SEL where the output of the comparator CP1 is taken as the select signal SEL. Specifically, when the voltage of the capacitor 3 is lower than the threshold voltage Vth3, the output of the comparator CP1 is at a low level, and a high reference voltage corresponding to a higher threshold voltage Vth1 is output by the select signal SEL at the low level. On the other side, when the voltage of the capacitor 3 rises to be higher than the higher threshold voltage Vth1, the output of the comparator CP1 then goes to a high level, and a low reference voltage corresponding to the lower threshold voltage Vth3 is output by the high-level select signal SEL.

Next, operation of the electronic timepiece 1 constructed as described above will be described.

Figure 2:
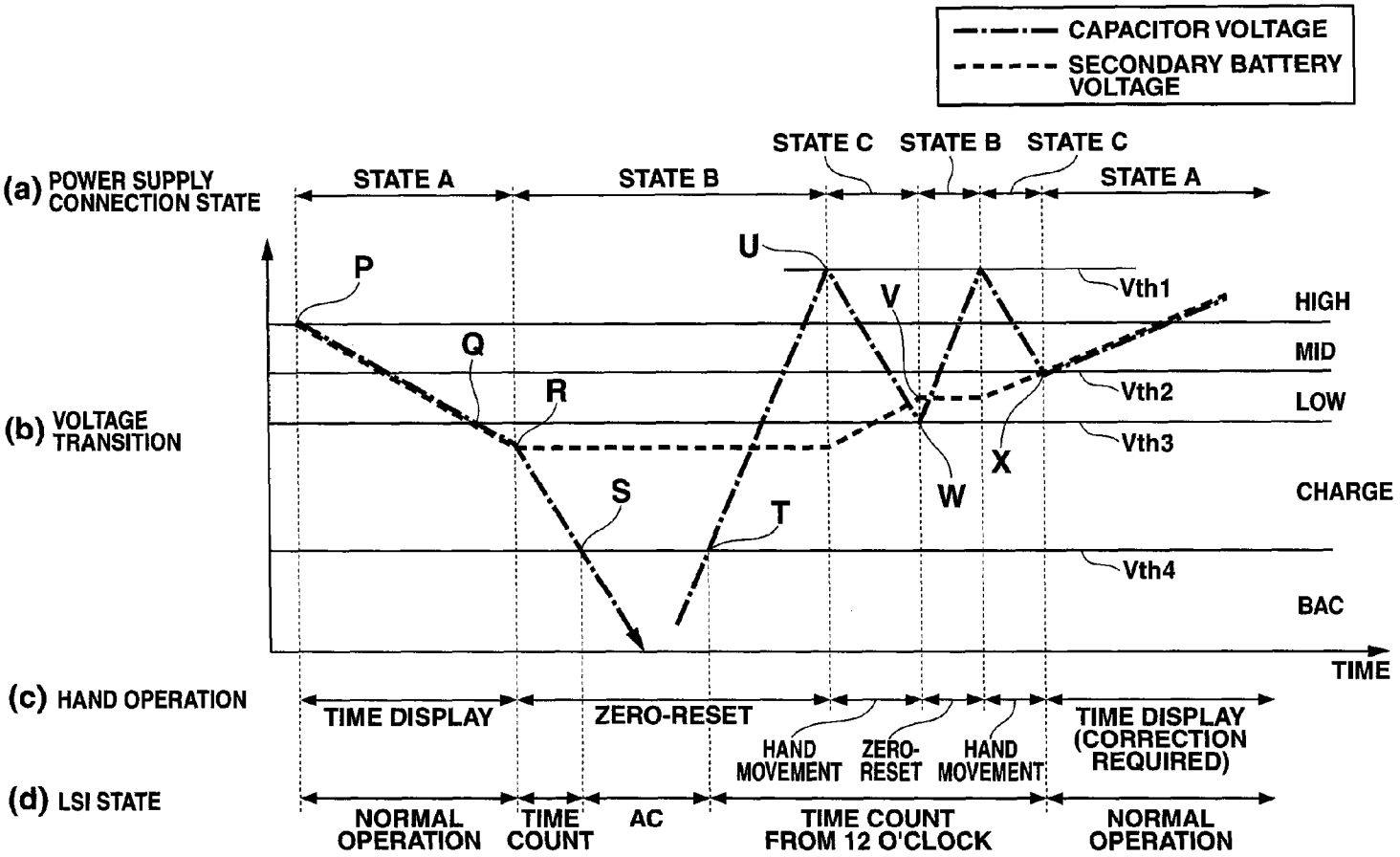
FIG. 2 is an explanatory graph expressing examples of power connection states, transition of a secondary battery voltage and a capacitor voltage, hand operation states, and variation patterns of LSI states.
Figure 3A:
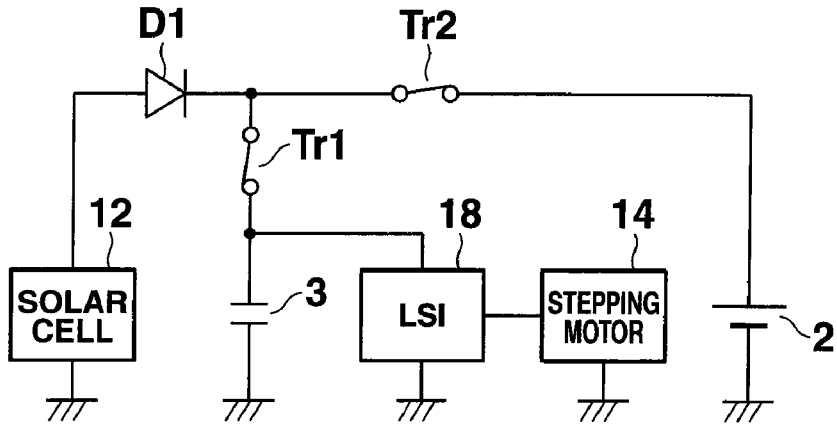
FIGS. 3A, 3B, and 3C are explanatory views depicting switching patterns of switches in power supply connection states in FIG. 2.
Figure 3B:
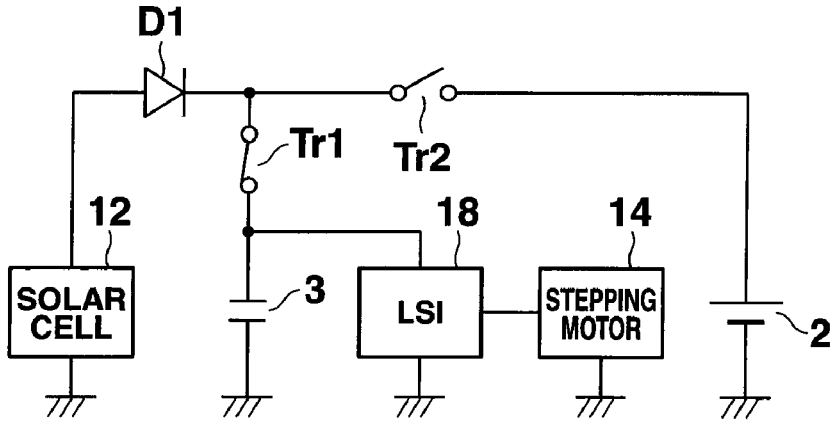
Figure 3C:
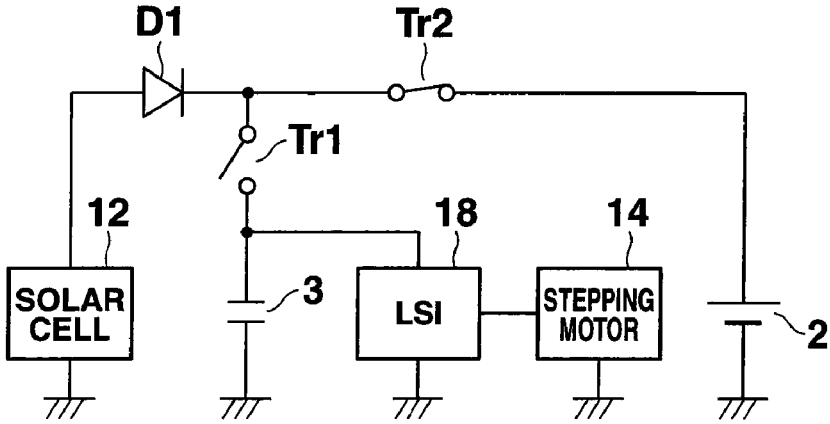

FIG. 2 graphically represents examples of voltage transition (b) of the secondary battery 2 and capacitor 3, a variation pattern (a) of power supply connection states according to the examples of transition, a variation pattern (c) of hand operation, and a variation pattern (d) of operation states of the LSI 18. FIGS. 3A to 3C are explanatory views illustrating switching patterns of the switches Tr1 and Tr2 in the power supply connection states A to C according to FIG. 2. FIGS. 3A to 3C illustrate the switches Tr1 and Tr2 arranged outside of the LSI 18, for easy understanding.

In the electronic timepiece 1 according to the present embodiment, a Low-level range (e.g., 2.2 to 2.3 V), a Mid-level (second level) range (e.g., 2.3 to 2.5 V), and a High-level range (e.g., 2.5 V or higher) are set as voltage levels of the power supply voltage at which time display is performed, as illustrated in the examples of voltage transition (b) in FIG. 2. Further, a charge-level (first level) range (e.g., 1.6 to 2.2 V) for stopping time display to avoid a voltage drop of the secondary battery 2, and a BAC-level range (e.g., 1.6 V or lower) for all clear the LSI 18 are set as much lower voltage-level ranges than those described above.

In the electronic timepiece 1 according to the present embodiment, the connection states of the power supply is set to one of a state A to a state C, in accordance with transition of voltages of the secondary battery 2 and capacitor 3.

In the power supply connection state A, both the switches Tr1 and Tr2 are on as illustrated in FIG. 3A. This power supply connection state A is configured to occur when the voltage level of the secondary battery 2 is in the High-level range, Mid-level range, or Low-level range, as illustrated in the power supply connection states (a) and examples of voltages transition (b) in FIG. 2. However, if once the voltage of the secondary battery 2 drops to the charge-level range, state A recovers after the voltage of the secondary battery 2 next recovers the Mid-level range.

When both the switches Tr1 and Tr2 are switched on as illustrated in FIG. 3A, both the secondary battery 2 and capacitor 3 are connected in parallel with the solar cell 12, and electricity from the solar cell 12 is supplied to both the secondary battery 2 and capacitor 3. Further, both the secondary battery 2 and capacitor 3 are connected in parallel with the load circuit (including the LSI 18 and the drive circuit 24 for driving the stepping motor 14), and electricity is supplied to the load circuit from both the secondary battery 2 and capacitor 3.

In the power supply connection state B, the switch Tr1 is on and the switch Tr2 is off, as illustrated in FIG. 3B. This power supply connection state B occurs when the capacitor 3 is in a predetermined charged state within a charge-required period until the voltage level of the secondary battery 2 next recovers to the Mid-level range after the voltage level of the secondary battery 2 drops to the charge-level range and thereby causes the hands 11 to be zero-reset (zero-reset will be described later), as illustrated in the power supply connection state (a) and the examples of voltage transition (b) in FIG. 2. That is, the power supply connection state B occurs within a period from when the voltage of the capacitor 3 once drops to the charge-level range to when the voltage of the capacitor 3 reaches the fully charged voltage Vth1 (third level: e.g., 2.6 V), in the charge-required period.

When the switch Tr1 is switched on and the switch Tr2 is switched off, as illustrated in FIG. 3B, the secondary battery 2 is separated from the load circuit, and electricity consumption of the secondary battery 2 ceases accordingly. Further, electricity from the solar cell 12 is supplied only to the capacitor 3, and that electricity to the load circuit is supplied only from the capacitor 3. Accordingly, when electricity generation is performed by the solar cell 12, the capacitor 3 is relatively rapidly charged so that an operation voltage can be supplied to the load circuit.

In the power supply connection state C, the switch Tr1 is off and the switch Tr2 is on, as illustrated in FIG. 3C. This power supply connection state C occurs within a period from when the voltage of the capacitor 3 reaches the fully charged voltage Vth1 to when the voltage of the capacitor 3 reaches the charge-level range (threshold voltage Vth3), in the charge-required period until the voltage level of the secondary battery 2 next recovers the Mid-level range after the voltage level of the secondary battery 2 drops to the charge-level range, as illustrated in the power supply connection state (a) and the examples of voltage transition (b) in FIG. 2.

When the switch Tr1 is switched off and the switch Tr2 is switched on, as illustrated in FIG. 3C, the secondary battery 2 is connected to the solar cell 12 with the secondary battery 2 separated from the load circuit. Accordingly, charge of the secondary battery 2 is caused to proceed. Further, the load circuit is connected to the capacitor 3, and an operation voltage is thereby supplied form the capacitor 3.

Such switching among the power supply connection states A, B, and C is actualized by voltage detection of the secondary battery 2 by the battery voltage detector 32, switching of settings of the latch circuit 42 performed by the CPU 21 based on the voltage detection, and voltage comparison by the capacitor 3 using the comparator CP1.

Next, an example of operation of the electronic timepiece 1 will be described in accordance with the examples of voltage transition (b) in FIG. 2.

Until the voltage of the secondary battery 2 drops to the charge-level range from the Mid-level range or higher (points P to Q in FIG. 2), the LSI 18 is in a normal operation state (normal operation mode) for displaying time. That is, time is clocked by the clock circuit 25, and the CPU 21 outputs a predetermined timing pulse to the drive circuit 24 in synchronism with the time clocking. Accordingly, the hands 11 are rotated indicating time. In the electronic timepiece 1 according to this embodiment, when the voltage of the secondary battery 2 drops to the Low-level range, the user is notified of a reduction of the charge amount, for example, by changing a drive pattern of moving the second hand one step forward for each second to another drive pattern of moving the second hand two steps forward for each two seconds.

During normal operation in which time display is performed by the hands 11, the state A illustrated in FIG. 3A is set as the power supply connection state. Accordingly, if electricity generation is performed by the solar cell 12, the secondary battery 2 and capacitor 3 are charged raising voltage levels. Otherwise, if electricity generation is not performed by the solar cell 12, voltage levels of the secondary battery 2 and capacitor 3 drop.

If clock operation continues without performing electricity generation and if the voltage of the secondary battery 2 drops to the charge-level range (point Q in FIG. 2), the battery voltage detector 32 detects the drop, and a zero-reset process is started under control of the CPU 21. The zero-reset process is to move the hands 11 to a predetermined return position (e.g., hour: 00/minute: 00/second: 00) and stop there. However, the hands 11 are driven in synchronism with time during the zero-reset process, as in the time display process, and therefore, neither the state of the LSI 18 nor operation of the hands 11 change. By this zero-reset process, the voltage of the secondary battery 2 drops to a voltage which is slightly lower than the charge-level range (points Q to R in FIG. 2).

Upon completion of the zero-reset process (point R in FIG. 2), the CPU 21 stops the drive process for the hands 11, and the hands 11 are put in a zero-reset state in which the hands 11 stop at the return position. Although the hands 11 stop in this case, the time clocking process of the clock circuit 25 is continued. Further, upon completion of the zero-reset process, the CPU 21 sets a data value "1" in the latch circuit 42. The power supply connection state is thereby switched to the state B. Accordingly, the secondary battery 2 is separated from the connection to the power supply source for the LSI 18, and only the capacitor 3 is connected.

If time further elapses without performing electricity generation after separating the secondary battery 2, the electricity supplied by the capacitor 3 is consumed by the LSI 18, and the voltage of the capacitor 3 drops to the BAC-level range (point S in FIG. 2). As the voltage of the capacitor 3 drops to the BAC-level range, an all clear signal is output from the BAC voltage detector 31, and the LSI 18 is then put in an all clear (AC) state. Further, the time clocking process of the clock circuit 25 stops.

Meanwhile, if electricity generation is performed in the power supply connection state B, the capacitor 3 is only one connection to a charge destination of the solar cell 12, and therefore, the voltage of the capacitor 3 rises relatively rapidly. Further, the voltage of the capacitor 3 firstly recovers the charge-level range (point T in FIG. 2). Then, the LSI 18 is started up in a reset state, and the time clocking process of the clock circuit 25 is restarted. In case of startup from the reset state, time counts starts from 12 o'clock.

If electricity generation is further continued and if the voltage of the capacitor 3 accordingly rises to the fully charged voltage Vth1 (point U in FIG. 2), the output of the comparator CP1 changes from the low level to the high level, and the power supply connection state is thereby switched to the state C. In the state C, as has been described previously, the solar cell 12 is connected to the secondary battery 2, while the LSI 18 is kept powered by the capacitor 3.

At the same time when the power supply connection state is switched to the state C (point U in FIG. 2), the output of the comparator CP1 is fed to the CPU 21, and the CPU 21 thereby starts an auxiliary drive process (hand operation (c) in FIG. 2).

In the auxiliary drive process, the CPU 21 executes predetermined pulse output to the drive circuit 24 thereby to move the hands 11 according to a defined movement pattern, move the hands 11 again and return to the reset state (hour: 00/minute: 00/second: 00), and stop there. The auxiliary drive process can be executed by an amount of electricity supplied by the fully charged capacitor 3. For example, an applicable needle movement pattern is to drive the second hand several steps clockwise and several steps anticlockwise from the position of 00 second, a predetermined number of times, and then to stop the second hand at the position of 00 seconds. Alternatively, if capacitance of the capacitor 3 is relatively large, an applicable needle movement pattern is to rotate the second hand by 360 degrees so as to return to the position of 00 second. Still alternatively, the minute hand and/or the hour hand may be moved, in place of limitedly moving the second hand, or an auxiliary hand may be moved if any auxiliary hand is provided in addition to the hands 11 for hour, minute, and second.

Since the auxiliary drive process is to move relatively rapidly the hands 11 when electricity generation is started in a state where the clock stops, the auxiliary drive process can be referred to as a quick start process.

If electricity generation is continued by the solar cell 12 in the period of this auxiliary drive process (points U to W in FIG. 2), generated electricity is charged in the secondary battery 2, and a charge level of the secondary battery 2 rises accordingly (point V in FIG. 2). Further, electricity is consumed from the capacitor 3 by the auxiliary drive process, and therefore, the voltage level of the capacitor 3 drops (point W in FIG. 2). However, since the auxiliary drive process is started when the capacitor 3 is fully charged, the hands 11 can be stopped at a predetermined return position before the voltage of the capacitor 3 drops to the charge-level range.

By the auxiliary drive process, the user can relatively rapidly check movement of the hands 11 when the electronic timepiece 1 is illuminated with light after the electronic timepiece 1 stops. The user can thereby recognize that the electronic timepiece 1 is in a charge state and causes no trouble. In addition, there is not a case that electricity supplied by the capacitor 3 may run out and stop the hands 11 halfway in the middle of the auxiliary drive process. Therefore, even if electricity generation is stopped when illumination of light ceases immediately after the auxiliary drive process is started, it is possible to avoid a situation that all-clear is executed when the hands 11 are located at any other positions than the return position, and positions of the hands are lost.

Upon completion of the auxiliary drive process (the hand movement (c) in FIG. 2), the hands 11 are stopped. However, the LSI 18 still operates, and the voltage of the capacitor 3 therefore drops soon to the charge-level range (point W in FIG. 2). Further, this drop causes the output of the comparator CP1 to be inverted to a low level, and the power supply connection state is switched to the state B. Further, if electricity generation is performed, the capacitor 3 is charged and the voltage of the capacitor 3 accordingly rises, as in the case of the points T to U in FIG. 2. Otherwise, if electricity generation is stopped, the voltage of the capacitor 3 drops or the LSI 18 is put in an all clear state, as in the case of the points R to S in FIG. 2.

In the example of FIG. 2, charge is continued even after the point W, the voltage of the capacitor 3 rises again to the fully charged voltage Vth1, and the auxiliary drive process is repeated. By thus repeating the auxiliary drive process, the charge level of the secondary battery 2 gradually rises. When the voltage of the secondary battery 2 further enters into the Mid-level range (point X in FIG. 2), this is detected by the detector 32 and notified to the CPU 21.

When the voltage of the secondary battery 2 enters into the Mid-level range, the LSI 18 then recovers normal operation. That is, the CPU 21 sets a data value "0" in the latch circuit 42 so that the power supply connection state is firstly switched to the state A. Both the switches Tr1 and Tr2 are thereby switched on, and the secondary battery 2 and the capacitor 3 are accordingly connected in parallel with the solar cell 12 and the load circuit. Further, under control of the CPU 21, the time display process is started to drive the hands 11 in synchronism with time clocking of the clock circuit 25. If once the voltage of the capacitor 3 drops to the BAC-level range, the LSI 18 is all reset, and the time clocked by the clock circuit 25 goes out of accurate time. Therefore, time is corrected, for example, by operating a radio receiver not illustrated so as to receive a time code.

Next, control processes of the CPU 21 which actualize the power supply switching process and the auxiliary drive process as described above is described in detail with reference to a flowchart.

Figure 4:
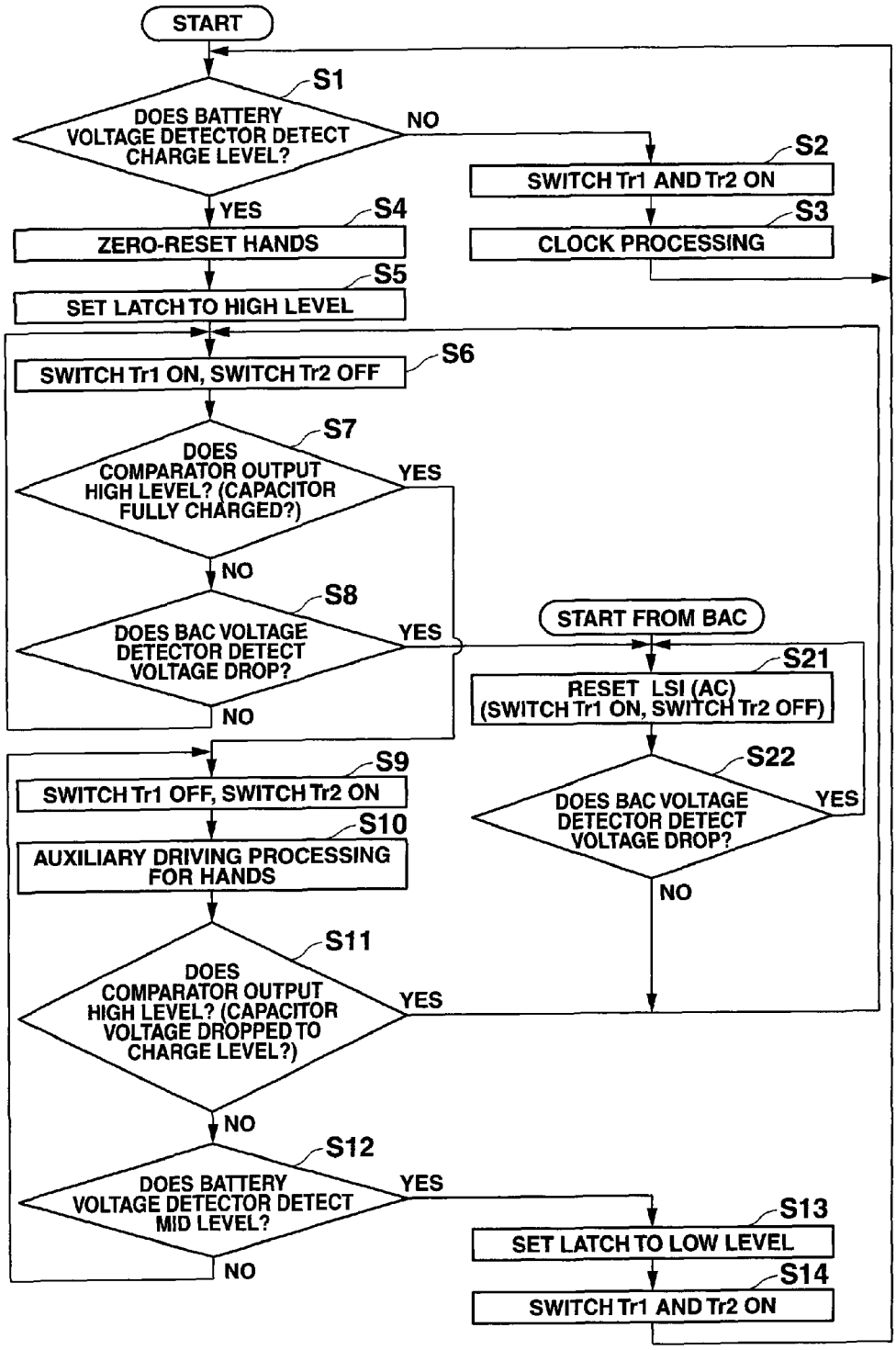
FIG. 4 is a flowchart illustrating a procedure of a timepiece control process executed by a CPU.

FIG. 4 draws a flowchart of a timepiece control process executed by the CPU 21.

This timepiece control process is started by the CPU 21 when powered on. Thereafter, the timepiece control process is continuously executed.

After this process is started, the CPU 21 firstly checks, in step S1, an output of the battery voltage detector 32 to determine whether the output is within the charge-level range. If the output is not within the charge-level range, the data level in the latch circuit 42 is not changed from the low level, and therefore, the switches Tr1 and Tr2 are still on (step S2). Also, if the output is not within the charge-level range, the voltage of the secondary battery 2 is within the Low-level range or higher. The CPU 21 therefore shifts to step S3 and executes a normal clock process, and then returns to step S1 again.

Through a loop process of steps S1 to S3, the clock process of step S3 is repeated, and the hands 11 are accordingly moved in synchronism with clock data of the clock circuit 25, to achieve time display.

Meanwhile, if the secondary battery 2 is determined, in step S1, to have reached the charge-level range, based on the output of the battery voltage detector 32, the loop process shifts to step S4, i.e., a zero-reset process for the hands 11. The zero-reset process of step S4 is a process which is completed by stopping the hands 11 when the hands 11 move to a predetermined return position (e.g., hour: 00/minute: 00/second: 00) while performing a needle move process according to the same pattern as in the clock process in step S3.

A process period of steps S1 to S5 corresponds to a period of the state A in FIG. 2.

Upon completion of the zero-reset process in step S4, the CPU 21 then goes to step S5 and sets a data value for the high level in the latch circuit 42. At this time, the output of the comparator CP1 is set to the low level, and therefore, the switch Tr1 is on and the switch Tr2 is off, according to the level of data set in the latch circuit 42 (step S6).

Next, the CPU 21 goes to step S7 and checks the output of the comparator CP1, to determine whether the output becomes the high level or not. Further, if the output does not become the high level, the CPU 21 goes to step S8 and checks whether or not there is a reset signal from the BAC voltage detector 31 which indicates a voltage drop to the BAC-level range. If determination results of both steps S7 and S8 are "NO", a loop process of steps S6 to S8 is repeated until either one of the results becomes "YES". The period of this repeated process corresponds to a period of the state B in FIG. 2 (excluding the AC period of the LSI state).

If the output of the comparator CP1 is determined to be changed to the high level, by the determination process in step S7, the switch Tr1 is switched off and the switch Tr2 is switched on, by the output of the comparator CP1 (step S9). Further, the CPU 21 goes to step S10 to perform the auxiliary drive process for the hands 11, based on the determination result.

After shifting to step S10, a process as a process for auxiliary driving of the hands 11 in this step is performed (auxiliary drive control module). Further, whether or not the output of the comparator CP1 becomes the low level is determined in step S11. If the output does not become the low level, whether or not the voltage of the secondary battery 2 has risen to the Mid-level range is determined based on the output of the battery voltage detector 32, in step S12. Further, if determination results of both steps S11 and S12 are "NO", a loop process of steps S9 to S12 is repeated until either one of the results becomes "YES". The period of thus repeated loop process corresponds to the period of state C in FIG. 2.

If the voltage of the secondary battery 2 is not charged to the Mid-level range in the loop process of steps S9 to S12, the process of the auxiliary drive process in step S10 is repeatedly executed, and the auxiliary drive process for one time is thereby accomplished from begging to end. Accordingly, the hands 11 are moved according to a predetermined movement pattern, and thereafter move to and stop at a predetermined return position. In this while, electricity consumption of the auxiliary drive process is constant, and therefore, the voltage of the capacitor 3 neither drop to the charge-level range nor is branched to a side of "YES" in step S11.

Upon completion of the auxiliary drive process for one time, electricity supplied by the capacitor 3 is consumed by the LSI 18 while the loop process of steps S9 to S12 is repeated. The voltage of the capacitor 3 accordingly drops to the charge-level range, and is thereby branched to the side of "YES" in step S11. If branched to the side of "YES" in step S11, the CPU 21 returns to step S6 and shifts to the process in the state B in FIG. 2 as described previously.

If, in the loop process of steps S9 to S12, the voltage of the secondary battery 2 goes under the lower limit value of the Mid-level range and is branched to the side of "YES" in the determination process in step S12, the CPU 21 goes to step S13 and sets the low level data in the latch circuit 42. Both the switches Tr1 and Tr2 are thereby switched on (step S14). Subsequently, the CPU 21 returns to step S1 and goes to the process in the state A in FIG. 2 as described previously.

If, in the loop process of steps S6 to S8 described above (the period of the state B in FIG. 2), the voltage of the capacitor 3 drops to the BAC-level range and transits to the side of the "YES" in the branching process in step S8. Due to a drop of the power supply voltage VDD, the LSI 18 is reset and the control process of the CPU 21 is suspended. Further, electricity generation is performed again, and the voltage of the capacitor 3 recovers the charge-level range. Then, the CPU 21 restarts processes from step S21.

After processes are restarted from step S21, the CPU 21 firstly starts up respective circuits in the LSI 18 from a reset state, in this step. At this time, the latch circuit 42 is reset to the data value for the high level, and the comparator output CP1 becomes a low-level output. Therefore, the switch Tr1 becomes on, and the switch Tr2 becomes off. Subsequently in step S22, whether or not the BAC voltage detector 31 detects a voltage drop to the BAC-level range is determined. If there is no voltage drop, the CPU 21 returns to step S6 and goes to the process in the state B in FIG. 2.

Due to such a timepiece control process as described above, following processes are implemented: the switch process for switching the power supply connection states depending on change of the power supply voltage as graphically expressed in FIG. 2; the process for stopping time display in the charge-required period of the secondary battery 2; and the process for performing auxiliary-driving of the hands 11 when the capacitor 3 is fully charged in the charge-required period of the secondary battery 2.

As has been described above, the electronic timepiece 1 according to the present embodiment is capable of performing auxiliary driving of the hands 11 if electricity generation by the solar cell 12 is restarted after the voltage of the secondary battery 2 drops to stop the time display process. Accordingly, the user can check movement of the hands 11 and recognize, for example, that the electronic timepiece 1 is in a charge state and causes no trouble.

The auxiliary drive process is capable of moving the hands 11 to a predetermined return position and of stopping the hands 11 there, by the full charge of the capacitor 3. Further, the auxiliary drive process is started when the capacitor 3 is fully charged. Therefore, even if electricity generation is stopped immediately after auxiliary driving is started, the hands 11 return to and stop at the predetermined return position. Even if the LSI 18 is then put in an all-clear state without performing electricity generation, the hands 11 are not lost.

When performing the auxiliary driving (the state C in FIG. 2), the solar cell 12 is connected to the secondary battery 2, and the load circuit (including the CPU 21 and the drive circuit 24) is connected to the capacitor 3. Further, during waiting time (the state B in FIG. 2) after the auxiliary driving, the solar cell 12 is connected to the capacitor 3. Accordingly, there is no electricity consumed by the secondary battery 2 before the voltage of the secondary battery 2 recovers after having once entered into the charge-required period. The secondary battery 2 can therefore efficiently recover the charge level. Further, only the capacitor 3 having small capacitance is charged if electricity generation is performed after stopping the hands 11. The voltage of the capacitor 3 can therefore rapidly rise and quickly start the auxiliary driving.

During normal operation of the electronic timepiece 1, both the switches Tr1 and Tr2 are switched on, so that both the secondary battery 2 and capacitor 3 are connected in parallel with the load circuit (including the CPU 21 and drive circuit 24). Therefore, even when the drive circuit 24 performs a dynamic drive process for the hands 11 which requires a relatively large current, such abrupt change in current can be responded to by the capacitor 3.

In addition, since the secondary battery 2 is used as a main power supply, and the capacitor 3 is used as an auxiliary power supply, constant power can be supplied for a long time by the secondary battery 2 having large capacitance during normal operation. Besides, in a scene that the charge level of the secondary battery 2 drops and auxiliary operation of the hands 11 is then performed, the power supply voltage VDD can be raised rapidly by the capacitor 3. Further, since the capacitor 3 can accurately obtain a charge amount from a voltage, completion of the charging of the capacitor 3 required for the auxiliary operation can be easily detected without excessively raising voltage detection accuracy.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein. For example, the present invention can be practiced as a computer readable recording medium in which a program for allowing the computer to function as predetermined means, allowing the computer to realize a predetermined function, or allowing the computer to conduct predetermined means.

Further, in the above embodiment, there has been described that a state of a drop or recovery of the charge level of the secondary battery 2 is determined from the battery voltage of the secondary battery 2. Such a state may be determined based on detection of any other factor than the battery voltage. Also in the above embodiment, there has been described that, if the battery voltage of the secondary battery 2 is dropped to the charge-level range, the charge level of the secondary battery 2 is determined to be entered into a charge-required period. If the battery voltage of the secondary battery 2 is raised to the Mid-level range, the charge level of the secondary battery 2 is determined to have recovered. However, voltage levels used for making these determines may be variously modified.

Also in the above embodiment, a threshold voltage Vth3 for determining that the secondary battery 2 is entered into a charge-required period, and a threshold voltage Vth3 for determining that the capacitor 3 is reached the charge voltage after auxiliary driving of the hands 11 are set to be equal. However, both of these threshold voltages need not be equal, e.g., the charge voltage of the capacitor 3 may be slightly higher than the voltage Vth3.

Furthermore, details disclosed in the embodiment may be appropriately changed within a scope not deviating from the gist of the invention, e.g., the details may include the return position of the hands 11, connection positions and a number of switches for switching connections of the secondary battery 2 and capacitor 3, a circuit configuration of the switching circuit for switching the switches, and a detailed procedure of the timepiece control process, etc.

What is claimed is:

1. An electronic timepiece comprising:

a drive module configured to drive a hand;

an electricity generation module;

first and second capacitor modules configured to store electricity supplied from the electricity generation module, the second capacitor module having a smaller capacitance than the first capacitor module;

a normal drive control module configured to be capable of causing the drive module to perform a time display driving by using electricity from the first and second capacitor modules; and an auxiliary drive control module configured to be capable of causing the drive module to perform an auxiliary driving that is different from the time display driving by using electricity from the second capacitor module;

a first switch between the electricity generation module and the second capacitor module;

a second switch between the electricity generation module and the first capacitor module; and a switching control module configured to control the first switch and the second switch by performing one of a first control, a second control, and a third control, based on a charge level of the first capacitor module and a charge level of the second capacitor module;

wherein in the first control, the switching control module causes the normal drive control module to perform the time display driving by turning on the first switch and the second switch, and wherein the switching control module performs the first control when the charge level of the first capacitor module is at a normal level or when the charge level of the first capacitor module has increased from a first level to a second level that is higher than the first level after decreasing from the normal level to the first level;

wherein in the second control, the switching control module causes the auxiliary drive control module to stop the auxiliary driving by turning on the first switch and turning off the second switch, and wherein the switching control module performs the second control when at least one of (i) the charge level of the first capacitor module has decreased to the first level and (ii) the charge level of the second capacitor module has decreased to the first level; and wherein in the third control, the switching control module causes the auxiliary drive control module to perform the auxiliary driving by turning off the first switch and turning on the second switch, and wherein the switching control module performs the third control when the charge level of the second capacitor module has increased from the first level to a third level that is higher than the first level and enables the auxiliary driving.

2. The electronic timepiece according to claim 1, wherein the first capacitor module comprises a secondary battery and the second capacitor module comprises a capacitor.

3. The electronic timepiece according to claim 1, further comprising:

at least one voltage detector module configured to perform voltage detection, wherein the at least one voltage detector module detects voltages of the first and second capacitor modules in order to determine whether or not the charge level of the first capacitor module reaches the first level and the second level, and whether or not the charge level of the second capacitor module reaches the third level.

* * * * *